US012782075B2

(12) United States Patent
Garst et al.

(10) Patent No.: US 12,782,075 B2
(45) Date of Patent: Nov. 3, 2026

(54) FIREARM SUPPRESSION DEVICE

(71) Applicant: Ascendance International, LLC, Littleton, CO (US)

(72) Inventors: Joseph Franklin Garst, New Castle, VA (US); Cory Steven Michalec, Lake Linden, MI (US); Darrell Alan Vinke, Winterport, ME (US); Charles Perry Gaff, II, Houghton, MI (US)

(73) Assignee: Ascendance International, LLC, Littleton, CO (US)

( * ) Notice: Subject to any disclaimer, the term of this patent is extended or adjusted under 35 U.S.C. 154(b) by 75 days.

(21) Appl. No.: 18/901,935

(22) Filed: Sep. 30, 2024

(65) Prior Publication Data

US 2026/0098696 A1 Apr. 9, 2026

Related U.S. Application Data

(60) Provisional application No. 63/586,642, filed on Sep. 29, 2023.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS

| | | | | |
|---|---|---|---|---|
| 1,004,666 | A | 10/1911 | Lewis | |
| 10,107,581 | B2 | 10/2018 | Garst et al. | |
| 10,746,491 | B2 | 8/2020 | Garst et al. | |
| 12,523,439 | B2 * | 1/2026 | Bray | F41A 21/30 |
| 2025/0277642 | A1 * | 9/2025 | Berkeypile | F41A 21/30 |
| 2025/0369714 | A1 * | 12/2025 | Shaw | F41A 21/30 |

* cited by examiner

*Primary Examiner* — J. Woodrow Eldred
(74) *Attorney, Agent, or Firm* — David Eyvazzadeh

(57) ABSTRACT

A firearm suppression device comprising multiple stages which are used to control the expansion and direct the expanding muzzle-blast gases (e.g., associated with the firing of a projectile from a firearm) in a manner to improve cooling, to reduce the firing signature of the weapon, and to vent the muzzle-blast gases out the distal end of the suppressor away from the operator's face which can potentially adversely affect the operator's vision and/or respiratory function.

19 Claims, 10 Drawing Sheets

SECTION B-B

DETAIL C

DETAIL D

SECTION A-A

SECTION E-E

SECTION F-F

1000

SECTION G-G

SECTION J-J

FIREARM SUPPRESSION DEVICE

CROSS-REFERENCE TO RELATED APPLICATIONS

This application claims the benefit of U.S. Provisional Application No. 63/586,642, filed Sep. 29, 2023, the content of which is herein incorporated by reference in its entirety for all purposes.

FIELD OF THE INVENTION

The present invention pertains in general to the suppression of firearm and weapon systems to mitigate audible, visual and temperature profiles when in use.

BACKGROUND OF THE INVENTION

Firearms, typically understood as a barreled weapon designed to launch a projectile toward an intended target have developed over centuries. Many developments have been made over the ages, but firearms have typically utilized the use of an explosive charge to create a rapidly expanding, controlled, and directed volume of gas to propel a projectile out of the end of a barrel at high velocities.

A large factor in the creation of sound when discharging a firearm, often referred to as a report, is due to the escape and rapid and uncontrolled expansion of the explosive charge out of the muzzle-end wherein the projectile exits the firearm. This sound surrounding the escape of the rapidly expanding gas out of the muzzle-end of a firearm is often referred to as muzzle-blast.

Due to the explosive nature of the charge driving the projectile, the muzzle-blast is also often accompanied with muzzle-flash. Muzzle-flash is the visible light that exits the firearm from the muzzle-end associated with an explosive charge originating from within the firearm.

In many situations it is desirable to mask, muffle, suppress or otherwise mitigate the muzzle-blast and muzzle-flash of a firearm during use. The mitigation or suppression of these factors of a firearm may provide the operator with an increased tactical advantage and when operating in a covert manner. Some of the advantages associated with this increased tactical advantage over an intended target or enemy due to the suppression of the muzzle-blast include—increased difficulty in identifying the location of the firearm, masking the direction from which the firearm is firing, the reduction of noise levels to safe hearing levels, and the altering of a characteristic noise signature, which may indicate the distance, type, or specific model of weapon.

A common solution to mitigate or suppress the muzzle-blast and/or muzzle-flash of a weapon surrounds the use of a suppressor, sometimes referred to as a "silencer" or "can," affixed to the muzzle-end of a weapon to provide an intermediate expansion volume for rapidly expanding gases related to the firing of the weapon. This intermediate expansion volume allows the control of the muzzle-blast and muzzle-flash within an enclosed space prior to exiting the suppressor. This intermediate expansion volume also allows controlled expansion of gases related to the explosive charge exiting the muzzle of the weapon. By the time the rapidly expanding gas from the explosive charge reaches the ambient environment, after passing through the intermediate expansion volume, the differential pressure between the explosive charge related gases and the ambient air is decreased. A decreased differential pressure, results in a lesser audible signature when such gases related to the explosive charge rapidly expand in the ambient air. The visual signature related to muzzle-blast and muzzle-flash is also decreased to a lesser level due to the intermediate expansion volume. This intermediate expansion volume is intended to suppress the audible and visual signatures, herein collectively referred to as "firearm signature," to levels offering increased tactical advantages.

The suppression of firearm signatures typically involves a device attached to the muzzle-end of a firearm to provide intermediate expansion volume and suppression of firearm signature with minimal or no impedance upon the trajectory or flight path of the projectile exiting the muzzle of the firearm.

SUMMARY OF THE INVENTION

A common problem with the use of suppressors in the field of firearm suppressors surround heat retained by the suppressor as well as an undesired phenomenon known as blowback. Blowback may occur with the use of a suppressor, through which rapidly expanding gases from the muzzle-blast of the firearm enter a restricted volume of the suppressor and cannot escape entirely through an aperture provided for the flight path of a projectile or other venting apertures. As a result, a portion of the rapidly expanding gases travel back down the barrel of the firearm back toward the operator of the firearm. Dependent upon the style of weapon, blowback gases may exit the weapon through parts of a weapon including an ejection port, trigger assembly, bolt, receiver or charging handle area such as with a firearm disclosed U.S. Pat. No. 5,351,598 to Schuetz, incorporated herein in its entirety by reference. The effects of blowback include an increased rate of carbon deposits within the working mechanisms of the firearm, increased operating pressure within a weapon, increased wear and tear of a weapon, and a decrease in reliability of a weapon. Furthermore, blowback sometimes results in gases exiting the weapon through previously discussed parts of the weapon after travelling back from the muzzle-end of the firearm and toward the operator. This blowback sometimes exits the weapon toward an operator's face and adversely affects the operator's vision or respiratory function, endangering the operator.

It is an aspect of the present invention to exhaust gases through a distal portion of the suppressor to distance the gases as related to the firing of a firearm as far from the operator as possible. Furthermore, it is an aspect of the present invention to provide expansion chambers which separate portions of the expanding gases and direct them into separate chambers which are sequestered from each other until exiting the distal end of the suppressor. In doing so, the flow of gases is controlled and directed toward the distal portion of the suppressor, and prevents the flow interference which may otherwise cause blowback.

It is a further aspect of certain embodiments of the present invention to provide cooling to the suppressor in a manner which allows the suppressor to generate its own cooling air-flow through the passive drawing of ambient air from the environment through a cooling jacket which surrounds the suppressor. The cooling jacket as disclosed herein serves as an improvement to the cooling jacket as proposed in the Air Cooled Automatic Firearm disclosed in U.S. Pat. No. 1,004,666 to Isaac Lewis ("Lewis") incorporated herein by reference in its entirety for all purposes. The technology of Lewis is limited in function as the action of the firing of the weapon serves to draw ambient air from the proximal end of the firearm toward the distal end of the firearm passively induce airflow for cooling purposes. Lewis teaches a plurality of channels created by radial fins between the barrel of a firearm and the outer aspect of the jacket. The channels of Lewis are strictly configured for carrying ambient air from a proximal aspect of the jacket to a distal end of the jacket which is distally located from the distal aspect of the barrel, wherein the passage of ambient air is configured to cool the barrel. While Lewis teaches the cooling of the firearm to cool the barrel, Lewis fails to address the cooling of firing gases after they exit the weapon. Furthermore, Lewis fails to obscure the muzzle-flash of a firearm.

It is an aspect of certain embodiments of the present invention to redirect firing gases to through channels which run longitudinally along the length of the suppressor to reduce temperature of the gases, and to reduce the report of the firing of the weapon. The channels vent out the distal aspect of the suppressor and are configured to provide heat transfer between the firing gases through an outer shell of the suppressor.

Certain existing technologies include the use of a multi-stage suppressor which uses a plurality of compartmentalized chambers to control the expansion and direct the expanding muzzle-blast gases, referred to as "gases" herein. An example of such technology for example is taught by U.S. Pat. No. 10,746,491 to Garst et al. ("Garst") which is incorporated herein by reference in its entirety for all purposes. Garst teaches the use of a suppressor device comprising a flow path which takes advantage a first volume for the expansion and travel of muzzle-blast gases from a proximal end of the suppressor toward the distal end, then expanding outward to a second volume prior to traveling back toward the proximal end of the suppressor prior to venting radially outward to the environment through apertures in the outer housing of the suppressor. It is an aspect of the present invention to improve upon this technology to provide improved cooling, to further reduce the firing signature of the weapon, and to vent the muzzle-blast gases out the distal end of the suppressor. In certain embodiments, the present invention receives gases from a proximal aspect of the second volume and directs them through closed vent tubes within a third volume for venting toward the distal end of the suppressor.

Another common problem surrounding the use of existing suppressor devices include factors that negatively affect an operator's interaction with the weapon. Suppressors are commonly made of a high thermal conductivity material such as steel or aluminum to further encourage drawing heat away from the weapon and suppressor, and radiate the heat to the environment. Such materials result in excess weight interconnected at a distal end of the weapon which increases the weight of a weapon in an asymmetric manner that affects the operator's ability to use the weapon in a manner consistent with normal use. A weapon with increased weight affixed to the muzzle-end, or firing-end, of the weapon is no longer balanced as it would be in normal operation without the affixed suppressor. This can cause inconsistent firing accuracy as well as accelerated fatigue of the weapon operator. Having the suppressor mounted at the muzzle-end of a weapon results in large moment forces on the weapon held by the operator. It will be appreciated that added weight is generally undesirable, and further it will be appreciated that unbalanced added weight on a weapon which is otherwise designed for balance will result in accelerated fatigue and potential inaccurate operation of a weapon. Thus, a device providing the benefits of modern suppressors at a reduced weight is desired to limit the accelerated fatigue of a weapon operator.

Yet another problem associated with the use of existing suppressor devices is the increased operating temperatures of the exposed housing of the suppressor and other heat conductive parts of a firearm such as metal rails. In some scenarios, the operating temperature of a suppressor may exceed temperatures of 426° C. (800° F.). A rail, or Picatinny rail, and other parts of a firearm may be appreciated to include, for example, those described by U.S. Pat. No. 9,032,860 to Faxon (Faxon) and U.S. Pat. No. 3,236,155 to Sturtevant (Sturtevant), each herein incorporated by reference in their entirety. Contact with a heated surface, such as the exposed housing of a suppressor by the operator or others in near proximity of the firearm may result in injury and distraction to the operator. Distractions in certain environments, such as covert operations or dynamic situations may result in life-threatening consequences to an operator or those surrounding them. As operators in military scenarios often work in teams, these life-threatening consequences may also affect a team, within which the weapon operator works.

It is an aspect of certain embodiments of the present invention to advantageously use 3D printing of materials such as titanium to manufacture suppressors which are both lightweight, but also provide reduced thermal conductivity as compared to materials such as steel and aluminum which are commonly used in the manufacture of suppressors. Certain embodiments of the present invention surround the 3D printing of a suppressor with materials such as titanium, polymers, and other 3D printable materials.

It is a further aspect of the present invention to provide increased heat mitigation through strategic cooling, and strategic routing of gases to more rapidly dissipate heat and from the suppressor, which reduces the build-up of heat energy through the repeated use of the weapon. Heat mitigation and cooling is accomplished through heat dissipation technologies including passive cooling, semi-passive cooling—such as driven by the gas flow associated with the firing of the weapon—and strategic flow of gases to effectively dissipate heat as related to the firing of the weapon while maintaining a reduced audible signature.

Certain existing suppressor technologies rely on trapping the resulting muzzle blast and associated gases within a suppressor and then slowly allowing the gases to passively vent out through an aperture which allows the projectile to pass therethrough. Such technologies result in an elevated temperature as the heat associated with the muzzle blast is trapped with the trapped gases, and therefore the suppressor absorbs a large portion of the heat from the muzzle blast.

It is an aspect of the present invention to provide constant heat dissipation, passive and semi-passive, to reduce the heat absorbed by the suppressor and offer consistent heat dissipation to reduce the temperature and overall heat signature of the suppressor. As discussed herein, "semi-passive heat dissipation" surrounds the dissipation of heat as a secondary byproduct of an action. In certain cases herein for instance, the action of a muzzle blast and projectile from the pathway from the distal end of the suppressor results in a low-pressure which results in the semi-passive cooling of the suppressor as ambient air is drawn through the cooling tubes from a proximal end of the suppressor to the distal end of the suppressor. Furthermore, for instance, the driving of muzzle blast gases through the vent tubes also results in a low-pressure which further results in the semi-passive cooling of the suppressor as the exit of muzzle blast gases through the vent tubes results again in a low-pressure zone, which draws ambient air through the vent tubes from a proximal end of the suppressor to the distal end of the suppressor.

In certain embodiments of the present invention, the semi-passive cooling of the suppressor occurs in two events. A first event occurs when the projectile and muzzle blast exits the pathway, creating a first low-pressure condition which draws ambient air through the cooling tubes from a proximal end of the suppressor to the distal end of the suppressor. Then the second event occurs as the muzzle blast gases directed into a second volume is directed through the vent tubes and out the distal end of the suppressor, thereby creating a second low-pressure condition to again draw ambient air through the cooling tubes from the proximal end of the suppressor to the distal end of the suppressor.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1:
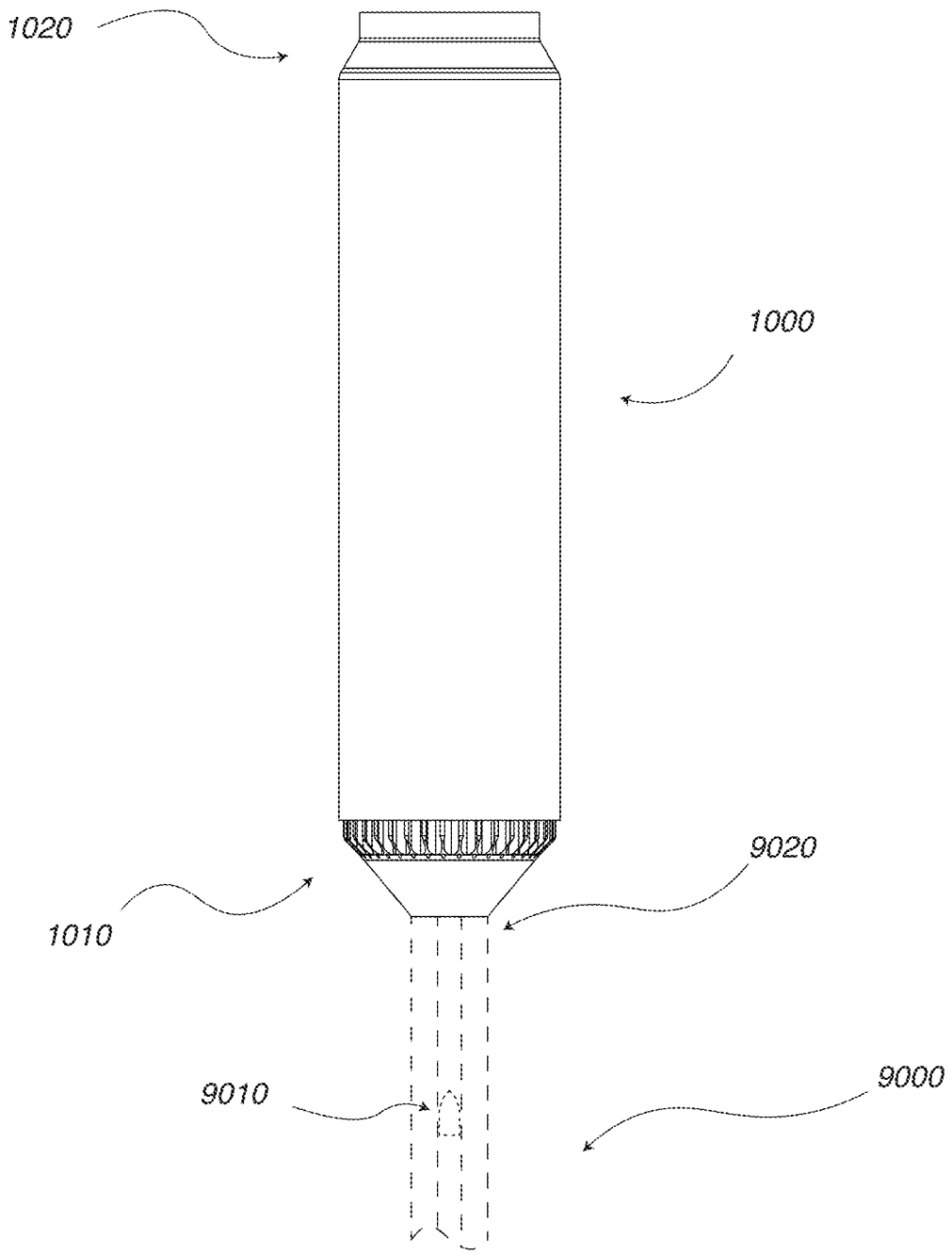
FIG. 1—A front view of certain embodiments of a suppressor of the present invention assembled with a firearm FIG. 2A—A front view of certain embodiments of a suppressor of the present invention FIG. 2B—Section view A-A of an embodiment of the suppressor as shown in FIG. 2A FIG. 2C—Section view B-B of an embodiment of the suppressor as shown in FIG. 2A FIG. 2D—Detail C an embodiment of the suppressor as shown in FIG. 2B FIG. 2E—Section view D of an embodiment of the suppressor as shown in FIG. 2C FIG. 2F—Section view A-A of an embodiment of the suppressor as shown in FIG. 2A demonstrating flow paths FIG. 3A—A front view of certain embodiments of a suppressor of the present invention FIG. 3B—Section view E-E of an embodiment of the suppressor as shown in FIG. 3A FIG. 3C—Section view F-F of an embodiment of the suppressor as shown in FIG. 3A FIG. 3D—Section view G-G of an embodiment of the suppressor as shown in FIG. 3A FIG. 4A—A transparent view of certain embodiments of a suppressor of the present invention FIG. 4B—Section view H-H of an embodiment of the suppressor as shown in FIG. 4A FIG. 5A—A transparent view of certain embodiments of a suppressor of the present invention FIG. 5B—Section view J-J of an embodiment of the suppressor as shown in FIG. 5A

Certain embodiments of the present invention, as shown in FIG. 1 for example, comprise a suppressor 1000 which is configured to be interconnected with the muzzle end 9020 of a barrel 9000 of a firearm. The suppressor 1000 is configured to be 3D printed as a unitary device out of materials such as titanium. However alternate embodiments comprising alternate materials, or alternate manufacturing methods are within the spirit and scope of the present invention.

In certain embodiments, as shown in FIG. 2A-FIG. 2F for instance, the present invention comprises suppressor 1000 with a proximal end 1010 configured to be interconnected to the muzzle-end 9020 of a firearm, a distal end 1020 configured to vent to the environment 9050, and a pathway 1050 extending therethrough. The pathway 1050 is configured to allow the passage of a projectile 9010 fired from the firearm to pass through the suppressor 1000 unrestricted.

In certain embodiments, as shown in FIG. 2A-FIG. 2F for instance, a first volume 1100 concentrically surrounds the pathway 1050, wherein the first volume 1100 extends from a proximal aspect 1010 of the suppressor toward a distal aspect 1020 of the suppressor. The first volume, similarly to the teachings of Garst, is configured to direct gases in a distal direction using a helical form 1130 to direct the majority of gases from the muzzle-blast radially outward away from the pathway 1050 within the first volume. When the gases reach a distal end 1120 of the first volume, the gases are directed radially outward into a distal end 1220 of a second volume 1200 which surrounds the first volume 1100. The second volume 1200 comprises a first shell 1250 which acts as an external boundary surrounding the first volume 1100, wherein the second volume 1200 comprises the volume between the first shell 1250 and an external boundary 1150 of the first volume. In certain embodiments the first volume 1100 and the second volume 1200 are concentric to each other, however embodiments discussed herein are not limited thereto.

In certain embodiments, as shown in FIG. 2A-FIG. 2F for instance, a first baffle 1400 placed distally from the distal ends 1110, 1210 of the first volume and the second volume allows the passage of a projectile therethrough, but limits the passage of gases therethrough. The first baffle 1400 is configured to guide flow of gases from the first volume 1100 into the second volume 1200 to reduce the gases preceding or following the projectile through the pathway 1050. The first baffle 1400 comprises an aperture 1410, typically centrally located, wherethrough the projectile 9010 can pass.

In certain embodiments, as shown in FIG. 2A-FIG. 2F for instance, the suppressor 1000 comprises a second baffle 1500 which comprises a form which is open toward the distal end of the suppressor which increases in volume, or tapers outward, to create an expansion feature 1530. The second baffle 1500 is located distally from the first baffle 1400 wherein the expansion feature 1430 is configured to create a low-pressure zone 1550 at the distal end following the baffle when the firearm is fired.

In certain embodiments, as shown in FIG. 2A-FIG. 2F for instance, the second volume 1200 surrounds the first volume 1100, and receives gases from the distal end 1120 of the first volume, wherein the first baffle 1400 is configured to direct gases toward the second volume 1200. The second volume 1200 is configured to direct gases from the distal end 1220 of the second volume toward the proximal end 1010 of the suppressor. At a proximal aspect 1210 of the second volume, at least one aperture 1230 is configured to receive gas from the proximal aspect 1210 of the second volume and direct the gases radially outward into a third volume 1300. The third volume 1300 is created by a second shell 1350 which acts as an external boundary surrounding the third volume 1300. In certain embodiments the third volume 1300 and the second volume 1200 are concentric to each other, however embodiments discussed herein are not limited thereto.

In certain embodiments, as shown in FIG. 2A-FIG. 4B for instance, the third volume 1300 comprises a plurality of tubes 1330 extending from the proximal aspect of the suppressor toward the distal aspect of the suppressor. Certain tubes 1330, referred to herein as vent tubes 1335, provide a pathway for muzzle-blast gases to be directed from the proximal aspect 1010 of the suppressor toward the distal aspect 1020 of the suppressor within the third volume 1300. Furthermore, certain tubes 1330 referred to herein as cooling tubes 1338, which are configured to draw cool ambient air from the proximal aspect 1010 of the suppressor, and direct the ambient air toward the distal aspect 1020 of the suppressor within the third volume 1300. In certain embodiments, the vent tubes 1335 and cooling tubes 1338 of certain embodiments as shown herein are isolated from each other with fins 1340 therebetween, wherein the fins 1340 provide heat transfer and cooling action to the suppressor.

In certain embodiments, as shown in FIG. 2A-FIG. 4B for instance, the muzzle-blast gases pass through a plurality of apertures 1230 at the proximal aspect of the suppressor wherein the apertures 1230 carry gases from the second volume 1200, into the third volume 1300, wherein the gases travel through vent tubes 1335 toward the distal aspect 1020 of the suppressor for venting. The vent tube 1335 is closed at a proximal end 1310, and extends longitudinally toward a distal end 1320 wherein the vent tube 1335 is open. The open distal end 1320 of the vent tube is configured to vent gases out from the distal aspect 1020 of the suppressor to mitigate the chances of the gases affecting the operator. The distal end 1320 of the vent tubes are located distally from the distal end 1120 of the first volume and the distal end 1220 of the second volume, and distally located in relation to the first baffle 1400 and the second baffle 1500.

In certain embodiments, as shown in FIG. 2A-FIG. 4B for instance, the distal end 1320 of the vent tubes are configured to be coincident with the low-pressure zone 1550. Furthermore, in certain embodiments the distal end of the vent tubes 1320 are configured to be coincident with a distal aspect of the expansion feature 1430 thereby maximizing the exposure of the distal end 1320 of the vent tube to the low-pressure zone 1550. The low-pressure zone 1550 is configured to increase the pressure differential in relation to the gases emitting from the vent tubes 1335 to provide a more rapid venting of the muzzle-blast gases from within the vent tubes 1335, and encourage the movement of gases from the first volume 1100 to the second volume 1200, and out through the vent tubes 1335 within the third volume 1300.

Certain embodiments of the present invention, as shown in FIG. 2A-FIG. 4B for instance, comprise a plurality of tubes 1330 (cooling tubes 1338 and vent tubes 1335) interconnected with the external boundary of the second volume, which is the first shell 1250 in certain embodiments. In certain embodiments the cooling tubes 1338 are interconnected with the first shell 1250, and are preferably within the third volume 1300. The cooling tubes 1338 extend from a proximal aspect 1010 of the suppressor, and toward the distal end 1020 of the suppressor. The cooling tubes 1338 are open at the proximal end 1310, and are open at the distal end 1320. The distal end 1320 of the cooling tubes are positioned in near proximity to those of the vent tubes 1335. In certain embodiments the cooling tubes 1338 and the vent tubes 1335 comprise similar diameters and are interconnected to the outer boundary 1250 of the second volume in a circular array, comprising fins 1340 therebetween. In certain embodiments, as shown, the vent tubes 1335 and cooling tubes 1338 comprise a linear form which extend from the proximal aspect 1010 of the suppressor toward the distal aspect 1020 of the suppressor. Alternate embodiments comprising vent tubes 1335 and cooling tubes 1338 with alternate forms, including helical forms, extending from the proximal aspect 1010 of the suppressor toward the distal aspect 1020 of the suppressor are within the spirit and scope of the present invention.

In certain embodiments, as shown in FIG. 2A-FIG. 4B for instance, the cooling tubes 1338 and vent tubes 1335 terminate in a circular array surrounding the low-pressure zone 1550. Alternate embodiments wherein the cooling tubes 1338 and the vent tubes 1335 are arranged in alternate arrays are within the spirit and scope of the present invention. The second ends 1320 of the cooling tubes 1338 and the vent tubes 1335 terminate distally from the first volume 1100 and the second volume 1200, and distally from the first baffle 1400 and the second baffle, and preferably coincident with the low-pressure zone 1550. In certain embodiments the termination of the vent tubes and the cooling tubes are arranged in a circular array surrounding the second baffle 1500.

A compression feature, as shown in FIG. 2A-FIG. 4B for instance, 1600 located distally from the termination of the vent tubes 1335 and the cooling tubes 1338, as well as distally from the low-pressure zone 1450, is configured to constrict in volume or taper inward approaching the distal end 1020 of the suppressor. The compression feature 1600 is configured to create a high-pressure zone 1650 to prevent the back-flow of gases and air through the vent tubes 1335 and cooling tubes 1338 from the distal end 1020 of the suppressor toward the proximal end 1010 of the suppressor. The high-pressure zone 1650 is subsequently followed by the ambient environment wherein the muzzle-blast gases and the ambient air escaping from the distal end 1020 of the suppressor expand into. Furthermore, the compression feature 1600 further serves to obscure the distal end 1020 of the suppressor to reduce the visual signature of the muzzle-blast when the weapon is fired. As shown from a distal view, the distal ends of the cooling tubes and the vent tubes are not visible when the suppressor 1000 is viewed directly from the distal end. Further still, the high-pressure zone 1650 is further intended to accentuate the low-pressure zone 1550 effect on the flow of gases and ambient air drawn through the vent tubes 1335 and cooling tubes 1338 from the proximal end 1010 of the suppressor toward the distal end 1020 of the suppressor. Thus, in certain embodiments the distal ends 1320 of the vent tubes and the cooling tubes vent to a low-pressure zone 1550, muzzle-blast gases and the ambient air from the distal ends 1320 of the tubes mix within the low-pressure zone 1550, which are then subjected to a high-pressure zone 1650 created by the compression feature 1600 prior to the mixed gases and ambient air expand into the surrounding environment 9050.

Figure 2A:
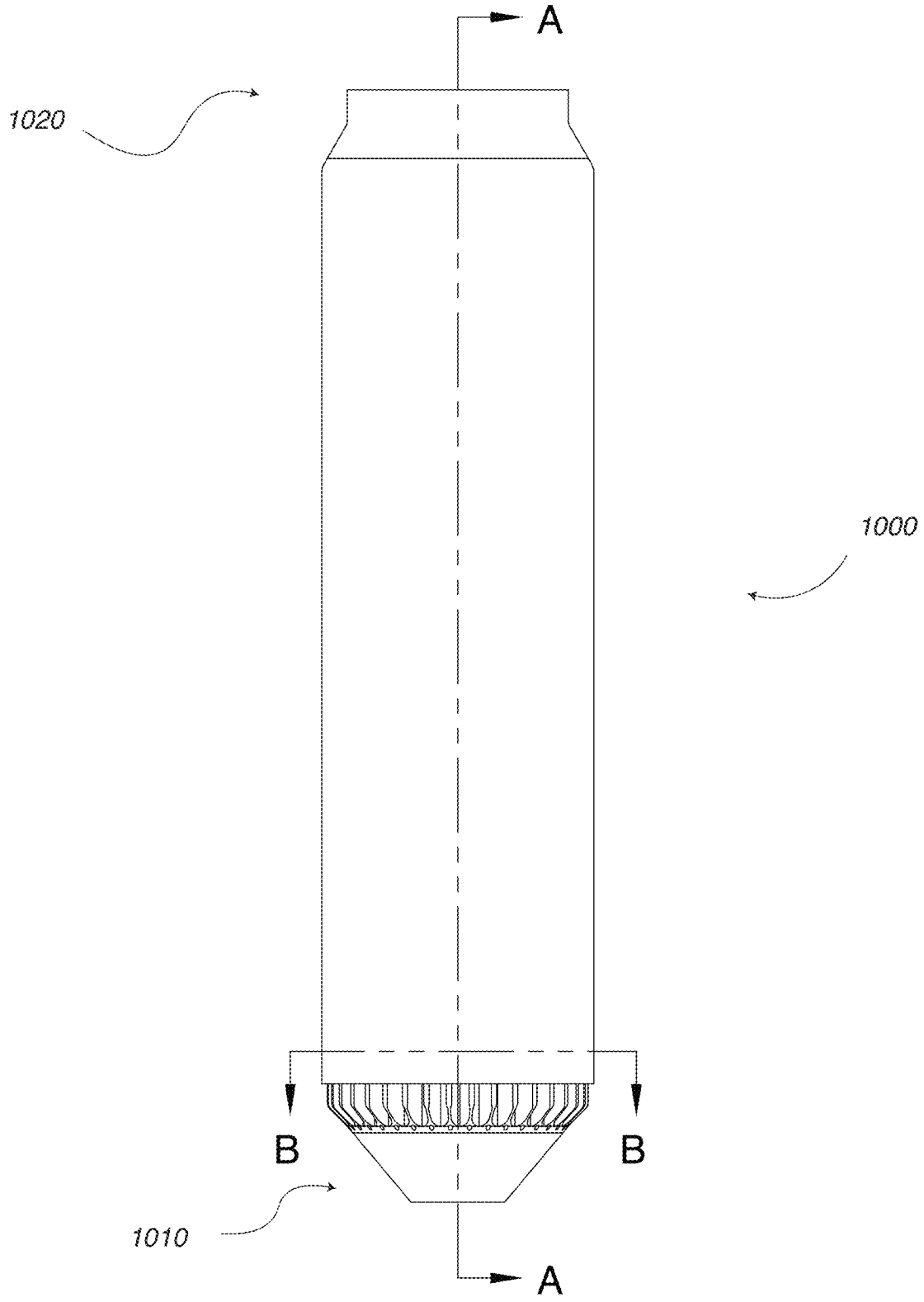
Figure 2B:
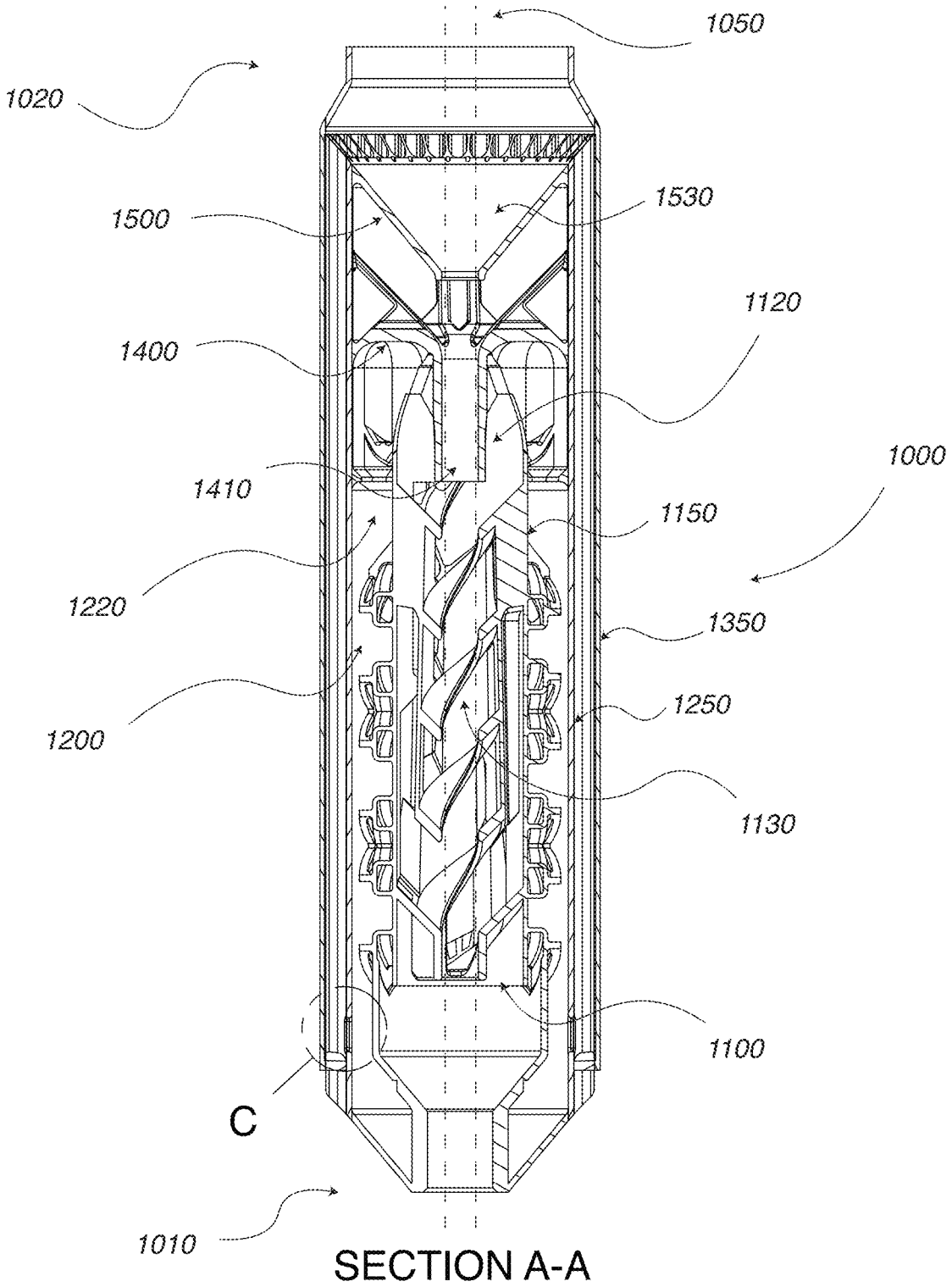
Figure 2C:
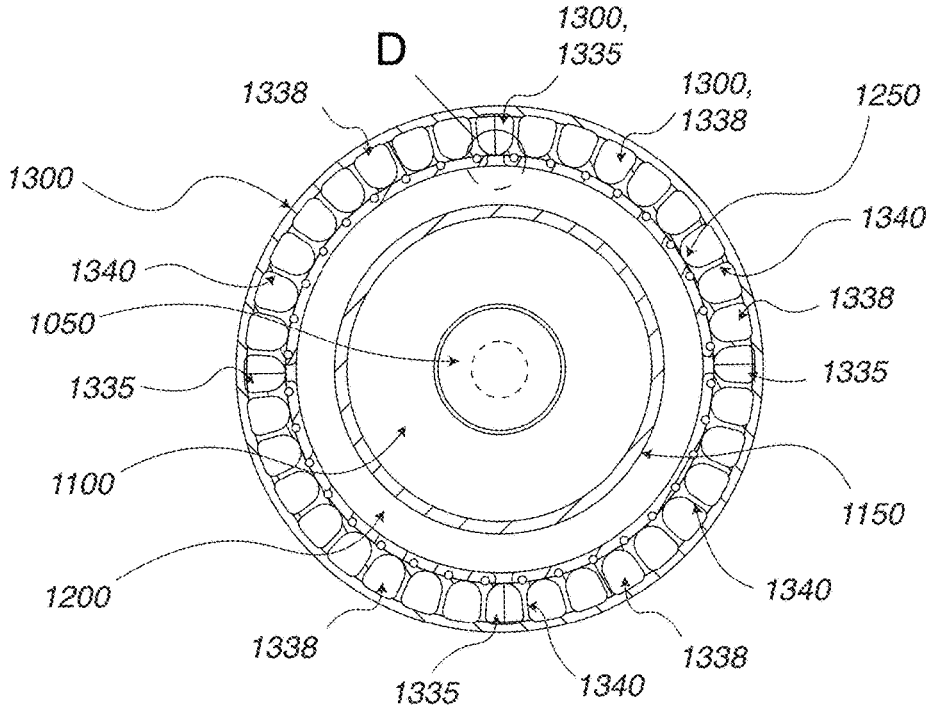
Figure 2D:
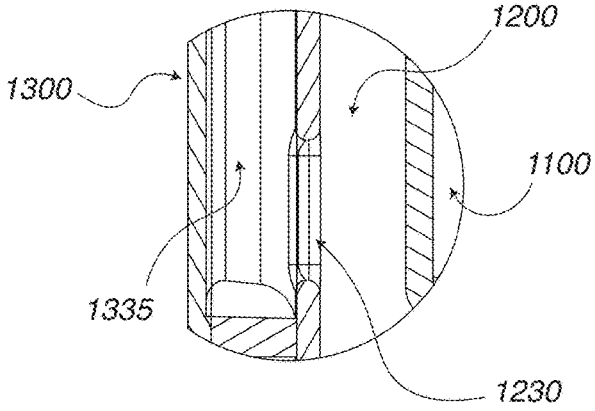
Figure 2E:
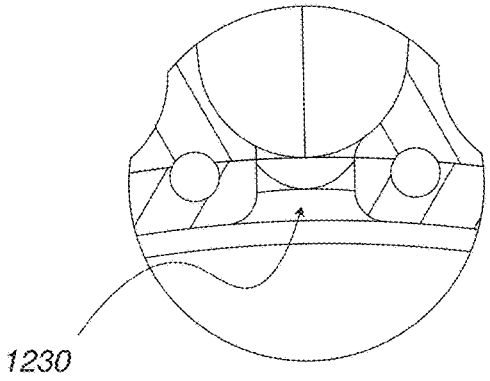
Figure 2F:
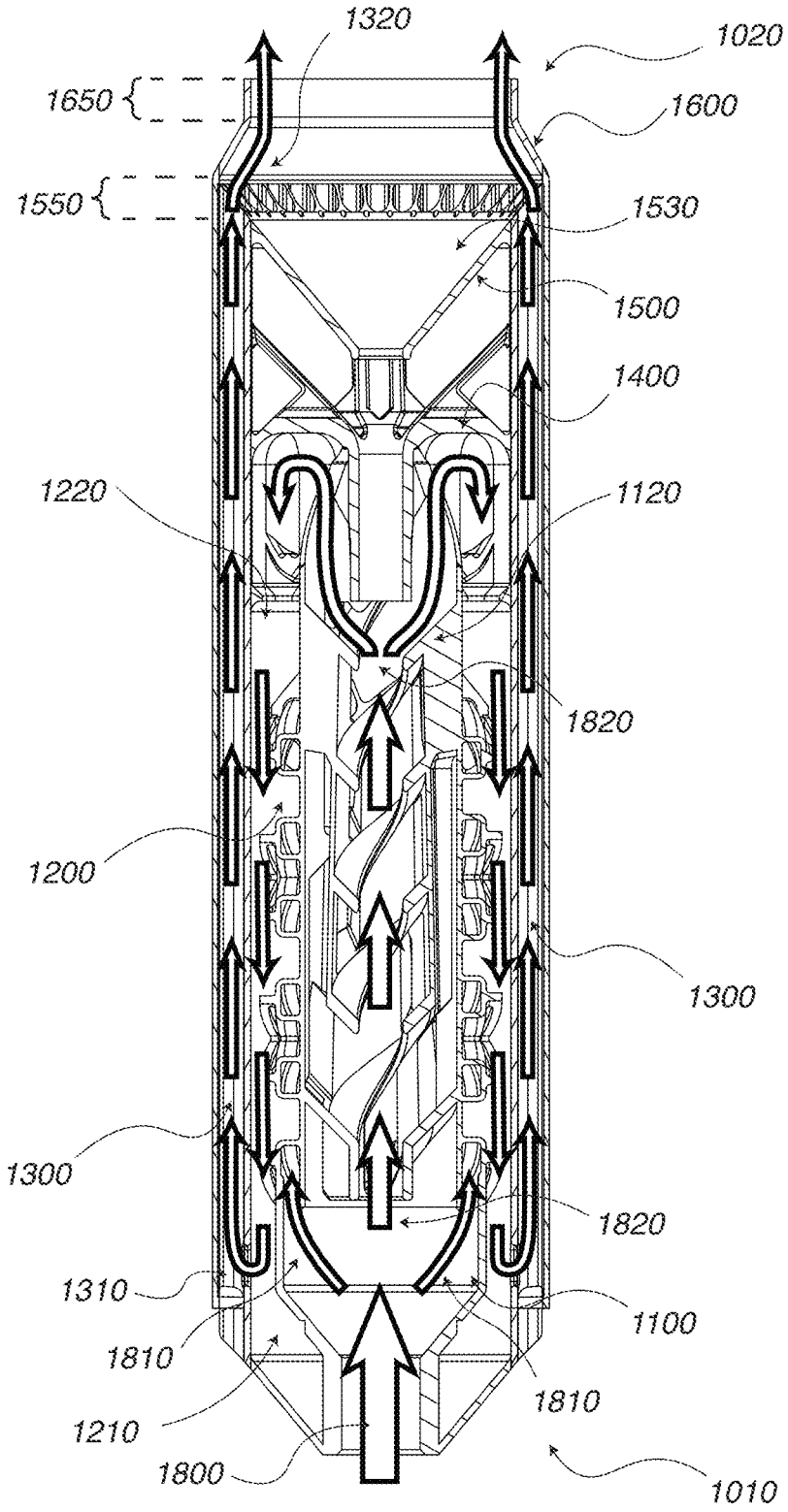
Figure 3A:
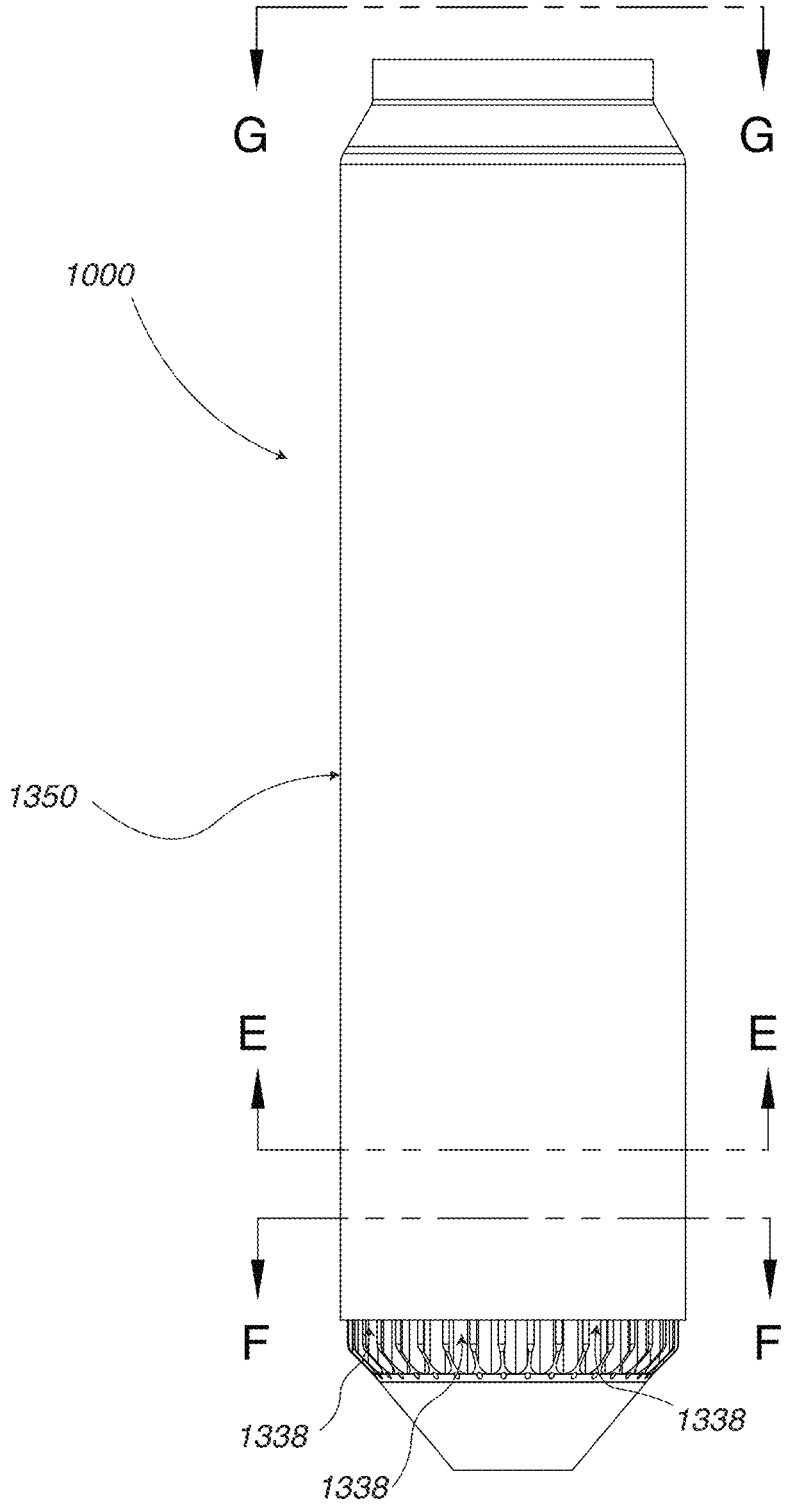
Figure 3B:
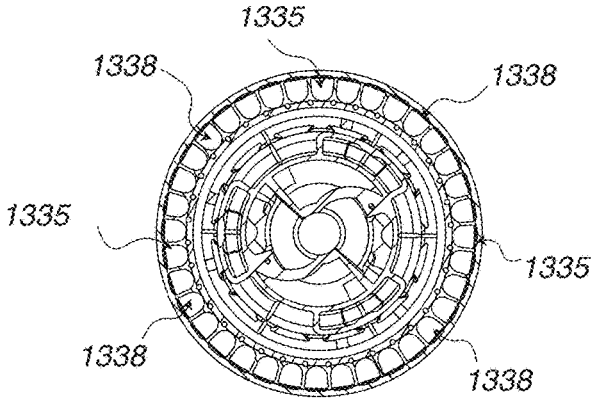
Figure 3C:
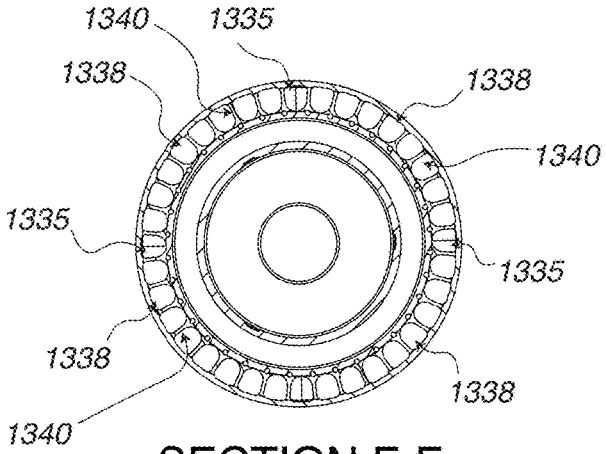
Figure 3D:
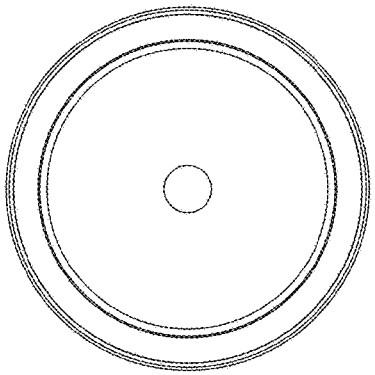
Figure 4A:
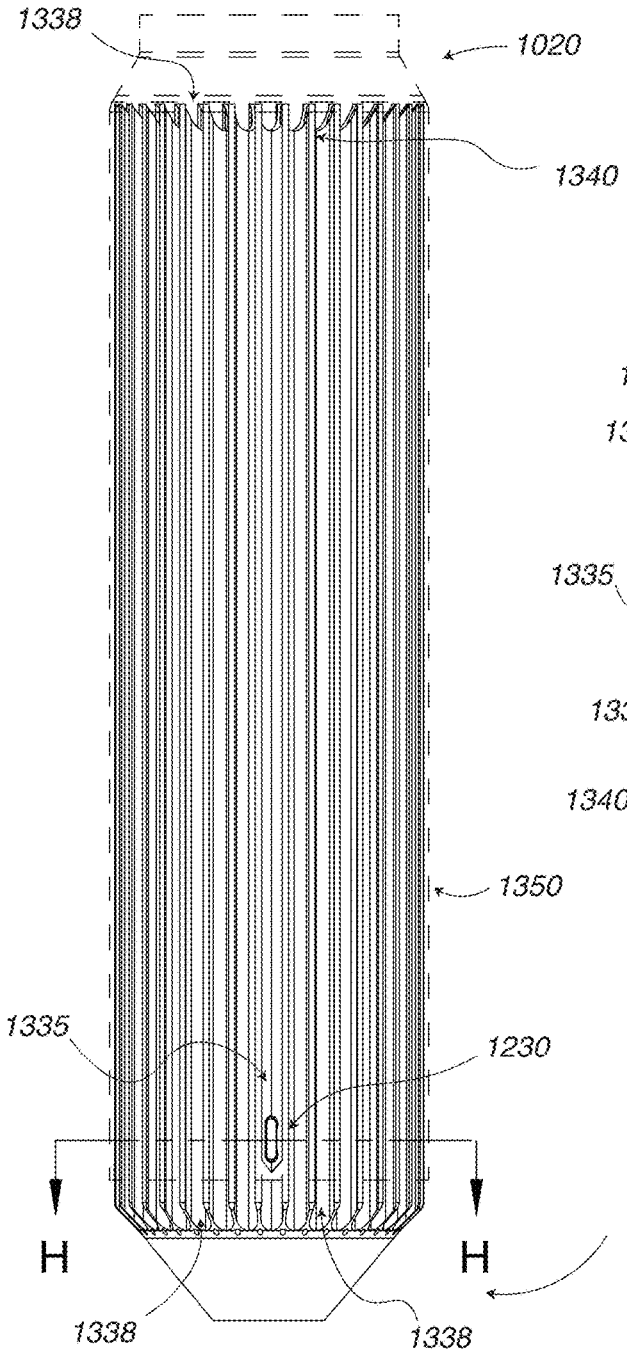
Figure 4B:
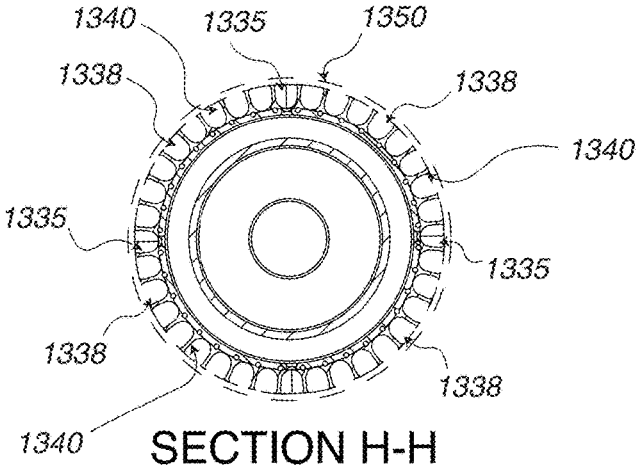
Figure 5A:
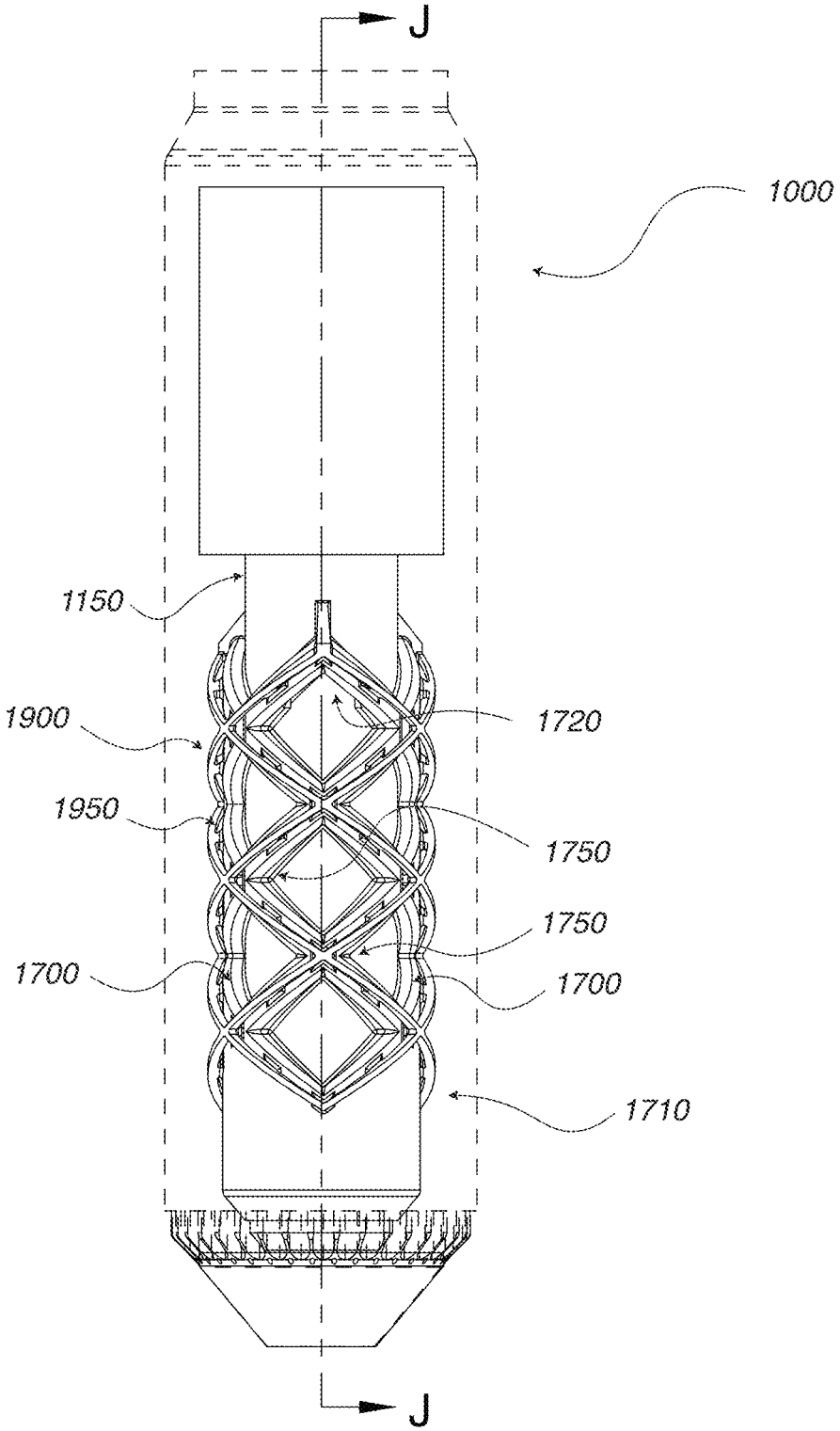
Figure 5B:
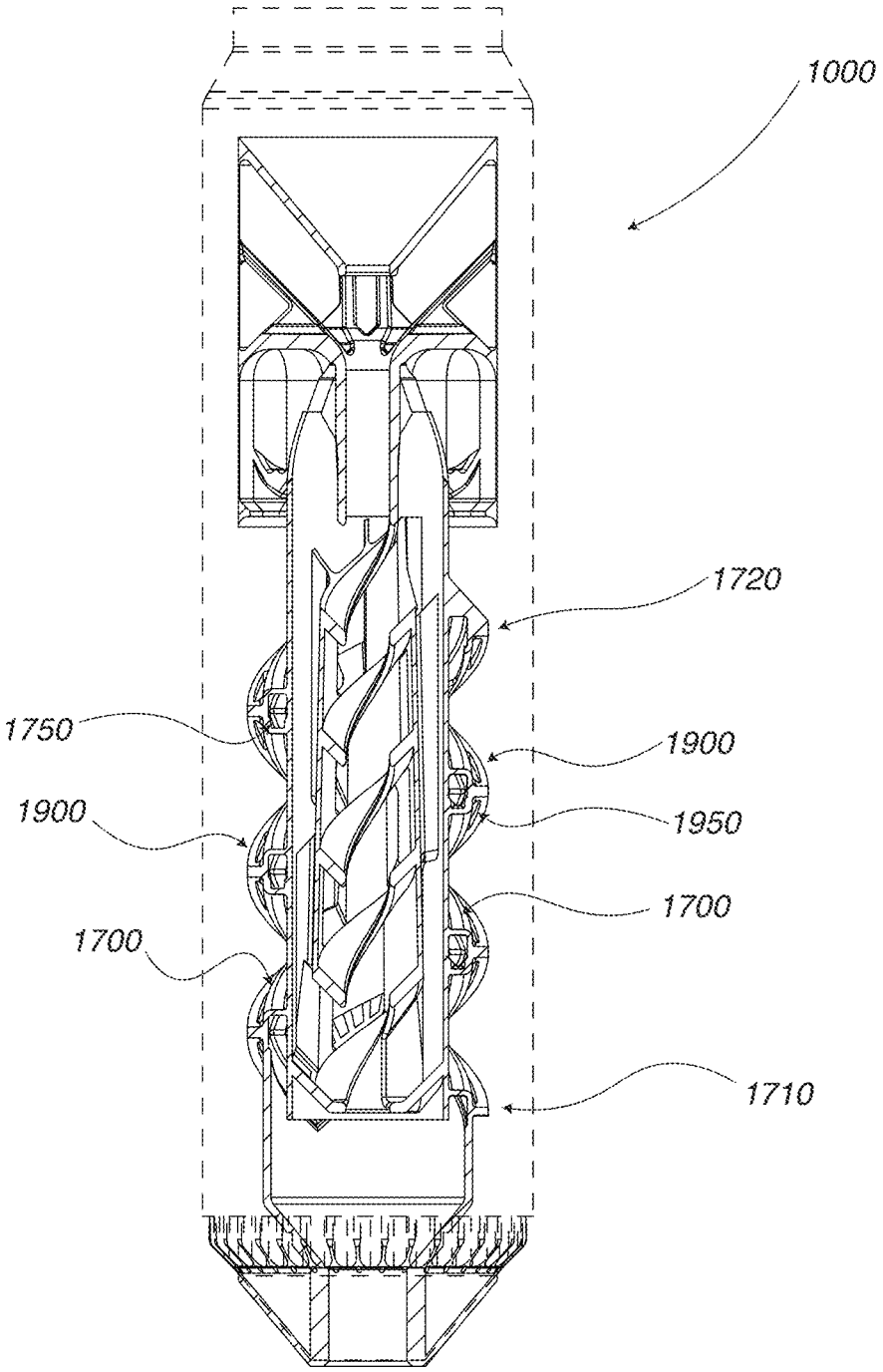

In certain embodiments, as shown in FIG. 2F and FIG. 5A-FIG. 5B for instance, a plurality of helical tubes 1700 are interconnected to the external boundary 1150 of the first volume wherein the helical tubes 1700 are counter-rotating in relation to each other. In certain embodiments the suppressor 1000 comprises three helical tubes 1700 rotating in a first direction, and three helical tubes rotating in a second direction, however alternate embodiments with varying numbers of helical tubes are within the spirit and scope of the present invention. The helical tubes comprise a proximal open end 1710 adjacent to the proximal end 1110 of the first volume. The helical tubes 1700 are configured to receive a first portion of gases 1810 from a proximal aspect 1010 of the suppressor. The first portion 1810 of gases are directed toward a distal end 1720 of the helical tubes which terminate into the second volume 1200, wherein the first portion 1810 of gases exit the helical tubes into the second volume 1200 toward the distal end 1220 of the second volume. A second portion 1820 of the gases travel through the first volume 1100 toward a distal end 1120 of the first volume. The second portion 1820 of the gases are directed through the first volume 1100 and into the second volume 1200 following interaction with the first baffle 1400. In certain embodiments the counter-rotating helical tubes 1700 intersect each other wherein the helical tubes 1700 are in fluid communication with each other at intersection locations 1750. As shown, the helical tubes 1700 extend outward into, but are fluidly isolated from, the second volume 1200, wherein the helical tubes induce turbulence in gas flow within the second volume 1200.

Certain embodiments, as shown in FIG. 5A-FIG. 5B for instance, of the present invention comprise turbulence inducing elements 1900 which extend further into the second volume 1200. In certain embodiments the turbulence inducing elements 1900 comprise fins 1950 with apertures 1960 therethrough, although fins 1950 without apertures 1960 are within the spirit and scope of the present invention. In certain embodiments, the fins 1950 interconnect with the helical tubes 1700 wherein the fins comprise a helical form mirroring the helical tubes 1700. While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A suppression device for firearms comprising:

a proximal aspect configured to be interconnected with a muzzle-end of a firearm, a distal aspect configured to vent to environment, and a pathway axially therethrough adapted to allow passage of a projectile therethrough;

a first volume concentrically surrounds the pathway and extends from the proximal aspect of the suppression device towards the distal aspect of the suppression device, wherein the first volume comprises helical elements adapted to direct gases radially outward from the pathway and toward the distal aspect of the suppression device;

a first baffle located distally from the first volume, wherein the first baffle is configured to direct gases from a distal aspect of the first volume, radially outward and into a distal aspect of a second volume;

the second volume concentrically surrounds the first volume, wherein gases within the second volume flow toward the proximal aspect of the suppression device via a plurality of apertures located at a proximal aspect of the second volume, wherein each aperture is fluidly interconnected to a vent tube, wherein each of the vent tubes comprises distally located open end, and wherein the vent tubes are configured to direct gas toward the distal aspect of the suppression device for venting;

a plurality of helical tubes, including a first helical tube having a form which rotates in a first direction, and a second helical tube having a form which rotates in a second direction, counter to the first direction, interconnected to an external boundary of the first volume, wherein the plurality of helical tubes receive a first portion of the gases at a proximal aspect of the plurality of helical tubes and direct the first portion of the gases in a distal direction, wherein a distal aspect of the plurality of helical tubes direct gases into the distal aspect of the second volume;

the first volume receives a second portion of the gases, wherein the first portion of the gases and the second portion of the gases intermix within the second volume;

the plurality of helical tubes are in fluid communication with each other at intersection locations, and sidewalls of the plurality of helical tubes extend into the second volume;

a plurality of turbulence inducing elements interconnected to the plurality of helical tubes which are configured to induce turbulence within the second volume;

an expansion feature located distally from the volumes, the expansion feature comprises a form of increasing volume directed toward the distal aspect of the suppression device, wherein the pathway extends therethrough, and wherein the expansion feature is configured to create a low-pressure zone when the projectile passes therethrough, a plurality of cooling tubes interconnected with an external boundary of the second volume, each cooling tube comprising a first end open to the environment at a proximal aspect of the suppression device, and each cooling tube further comprising an open second end at the distal aspect of the suppression device, wherein the second end of the cooling tubes and the open end of the vent tubes are coincident with the low-pressure zone, wherein the low-pressure zone is configured to draw gases through the vent tubes, and further draw ambient air through the cooling tubes; and a compression feature distally located from the expansion feature, wherein the compression feature constricts in volume as it approaches the distal aspect of the suppression device, resulting in a high-pressure zone distally located from the low-pressure zone, and prior to venting to the environment.

2. A suppression device comprising:

a proximal aspect of the suppression device configured to be interconnected with a muzzle-end of a firearm, a distal aspect of the suppression device configured to vent to environment, and a pathway extending therebetween adapted to allow passage of a projectile therethrough;

a first volume surrounding at least a portion of the pathway, wherein the first volume includes one or more features adapted to direct a first portion of gases, originating from the proximal aspect of the suppression device and flowing toward the distal aspect of the suppression device, from the first volume to a second volume surrounding at least a portion of the first volume;

a first baffle located at a distal end of the first volume, wherein the first baffle is configured to direct a second portion of the gases from the first volume to the second volume;

one or more first apertures located at a proximal aspect of the second volume, configured to direct the first portion of the gases and the second portion of the gases from the second volume into one or more vent tubes which extend from the proximal aspect of the suppression device, toward the distal aspect of the suppression device.

3. The suppression device of claim 2, wherein the one or more vent tubes comprise a closed proximal end, closed to ambient air, wherein the one or more vent tubes are configured to carry the first portion of the gases and the second portion of the gases toward the distal aspect of the suppression device to exit through an open distal end of the one or more vent tubes.

4. The suppression device of claim 3, further comprising a second baffle, located proximally in relation to the distal end of the one or more vent tubes, wherein the second baffle is configured to direct at least a third portion of the gases from the pathway toward the distal aspect of the suppression device.

5. The suppression device of claim 4, wherein the second baffle further comprises an expansion feature configured to create a low-pressure zone distally from the second baffle.

6. The suppression device of claim 5, wherein a distal aspect of the expansion feature coincides with the distal end of the one or more vent tubes.

7. The suppression device of claim 6, further comprising a compression feature distally located in relation to the distal end of the one or more vent tubes, wherein the compression feature is configured to create a high-pressure zone distally from the distal end of the one or more vent tubes.

8. The suppression device of claim 7, further comprising one or more cooling tubes extending longitudinally along the suppression device, from the proximal aspect of the suppression device to the distal aspect of the suppression device, wherein a proximal end of the one or more cooling tubes is open to the ambient air, and a distal end of the one or more cooling tubes is open to the ambient air.

9. The suppression device of claim 8, wherein a first cooling tube of the one or more cooling tubes is adjacent a first vent tube of the one or more vent tubes.

10. The suppression device of claim 9 wherein the first vent tube and the first cooling tube are separated by a first fin.

11. The suppression device of claim 8, wherein the low-pressure zone created by the expansion feature is configured to draw the ambient air from the proximal end of the one or more cooling tubes, through the distal end of the one or more cooling tubes.

12. The suppression device of claim 2, wherein the one or more features configured to direct the first portion of the gases from the first volume to the second volume, includes one or more helical tubes interconnected to an outer boundary of the first volume, the one or more helical tubes comprising:

a proximal end in fluid communication with the first volume; and a distal end, distally located from the proximal end of the one or more helical tubes, in fluid communication with the second volume.

13. The suppression device of claim 12, wherein the one or more helical tubes protrude from the outer boundary of the first volume, into the second volume.

14. The suppression device of claim 12, wherein the one or more helical tubes include a first helical tube rotating in a first direction, and a second helical tube rotating in a second direction, different than the first direction, wherein the first helical tube and the second helical tube are in fluid communication at a first intersection location.

15. The suppression device of claim 2, further comprising one or more turbulence inducing elements which extend from an outer boundary of the first volume, into the second volume.

16. The suppression device of claim 15, wherein the one or more turbulence inducing elements include a first helical fin rotating in a first direction, and a second helical fin rotating in a second direction, different than the first direction.

17. The suppression device of claim 16, wherein the helical fins include one or more apertures therethrough.

18. The suppression device of claim 2, wherein the first volume further comprises a helical form extending longitudinally therein, wherein the helical form is configured to direct the second portion of the gases radially outward.

19. The suppression device of claim 2, wherein a third portion of the gases pass through an aperture of a second baffle, and vent to ambient air.

* * * * *